US005864279A

United States Patent [19]

Becher et al.

[11] Patent Number: 5,864,279

[45] Date of Patent: Jan. 26, 1999

[54] TEMPERATURE-DEPENDENT SWITCH WITH A RETAINING BRACKET

[75] Inventors: Michael Becher, Althengstett; Edwin Güttinger, Königsbach, both of Germany

[73] Assignee: Thermik Gerätebau GmbH, Pforzheim, Germany

[21] Appl. No.: 21,849

[22] Filed: Feb. 11, 1998

[30] Foreign Application Priority Data

Feb. 13, 1997 [DE] Germany ..... 197 05 410.2

[51] Int. Cl.[6] ..... H01H 37/04

[52] U.S. Cl. ..... 337/380; 337/333; 337/381; 337/342; 337/365

[58] Field of Search ..... 337/380, 333, 337/381, 342, 365, 372, 383, 398; 361/104, 105

[56] References Cited

U.S. PATENT DOCUMENTS 4,297,668 10/1981 Place ..... 337/365
5,011,101 4/1991 Buchser ..... 248/27.3
5,670,930 9/1997 Hofsass et al. ..... 337/380
5,699,033 12/1997 Hofsass ..... 337/380

FOREIGN PATENT DOCUMENTS 3817080 6/1993 Germany .
4142180 7/1993 Germany .
3904463 10/1996 Germany .

*Primary Examiner*—Leo P. Picard
*Assistant Examiner*—Anatoly Vortman
*Attorney, Agent, or Firm*—Harness, Dickey & Pierce, P.L.C.

[57] ABSTRACT

An apparatus (10) for protecting an electrical device (11) from overtemperature comprises a temperature-dependent switch (22) with a housing (23) on whose base (28) a first connecting contact (51) is provided. A second connecting contact is provided on the housing (23). Also provided is a holder (14) which carries the housing (23) and has an external terminal (27) connected to the second connecting contact. The holder (14) is electrically insulated with respect to the base (28) of the housing (23) and is designed, in the state as mounted on the device (11), to press the base (28) of the housing (23) onto a contact surface (29) provided on the device (11).

10 Claims, 2 Drawing Sheets

TEMPERATURE-DEPENDENT SWITCH WITH A RETAINING BRACKET

BACKGROUND OF THE INVENTION

1. Field of the Invention

The present invention concerns an apparatus for protecting an electrical device from overtemperature, having a temperature-dependent switch with a housing on whose base a first connected contact is provided, a second connecting contact provided on the housing, and a holder which carries the housing and has an external terminal connected to the second connecting contact.

2. Related Prior Art

An apparatus of the kind mentioned above is known from DE 38 17 080 C2.

The known apparatus comprises a holder made of plastic, in which a temperature-dependent switch with a two-part metal housing is arranged. The connecting contacts of the temperature-dependent switch are constituted on the one hand by the metal cover and on the other hand by the metal lower part, a bimetallic switching mechanism (known e.g. from DE-A-21 21 802) being arranged in the interior of the switch.

The known apparatus is slid onto connector lugs of an electric motor and itself has a connector lug which is accessible from outside.

The connector lug of the holder is connected to a thermal contact plate which, in the case of an apparatus placed on the electric motor, rests directly on the energizing winding. In the interior of the holder, the metal housing rests with its base on the contact plate, so that there is thermal contact with the electric motor, and electrical contact with the connector lug of the holder.

Pressing on the metal cover is a connecting spring which is joined to a connector lug of the electric motor but is no longer accessible from outside once the apparatus has been put in place. The second connector lug of the electric motor, and the connector lug of the holder, serve as external terminals of the electric motor equipped with the known apparatus.

With the arrangement described, the temperature-dependent switch is arranged in series with the electric motor between the two external terminals. If the temperature of the energizing winding increases above a defined value, the bimetallic switching mechanism then opens the electrical contact between the metal cover and metal lower part, so that an electrical voltage applied to the external terminals can no longer power the electric motor. This prevents the electric motor from heating up, during operation, above a defined temperature; i.e. it is protected from overtemperature.

For many applications the known apparatus is not suitable, since the holder used therein is on the one hand much too bulky to be mounted on small electrical household appliances, for example a coffee machine, an electric hotpot, or electrical hotplates. A further disadvantage of the known apparatus lies in the fact that it cannot track rapid temperature changes without delay, since heat is dissipated to the connector lugs via the metal cover and the metal lower part.

Rapid reaction to a temperature rise is, however, required specifically in the case of electric hotpots or hotplates, for example in order to prevent the hotpot, or a pot sitting on the hotplate, from boiling dry. Protection from boiling dry cannot be achieved by monitoring power consumption, since the amperage remains relatively constant regardless of whether or not water is still present; the temperature of the electrical device to be protected simply rises, rapidly and steeply, when the water has boiled off.

Apparatuses which protect household appliances from overtemperature are subject in general to particularly stringent demands in terms of electrical, mechanical, and thermal reliability, which are not met by the known apparatus.

SUMMARY OF THE INVENTION

In view of the above, it is an object of the present invention to provide, with little design effort, for an apparatus of the kind mentioned at the outset which, with good thermal coupling, guarantees secure mechanical retention on the device to be protected and is easy to install thereon.

According to the invention, this object is achieved with the apparatus mentioned at the outset in that the holder is electrically insulated with respect to the base of the housing and is designed such as to press the base of the housing onto a contact surface provided on the device, when being mounted on said device.

The object underlying the invention is completely achieved in this manner.

Specifically, the inventors of the present application have recognized that in the case of a temperature-dependent switch as used in prior art apparatus, it is possible to combine electrical connection and thermal coupling, which is readily possible in particular with planar thick-film heating systems. Advantage is taken, in this context, of the fact that a good electrical contact is also always a good thermal contact, so that pressing the base of the housing results in good thermal coupling of the switch to the device to be protected.

Because the holder is insulated with respect to the base of the housing, no heat is dissipated through the latter, so that nearly no switching delays occur. The cover is also insulated with respect to the base, so that it has only a minor influence on the heat dissipation that can take place toward the external terminal.

It is thus an advantage of the new apparatus as so far described that it reacts thermally very quickly, since coupling is good and heat dissipation is low. A further advantage is the fact that one electrical connection to the device is eliminated, since the second terminal of the device is constituted by the external terminal of the new apparatus.

A further advantage lies in the great security of the new apparatus, since the holder can be bolted or welded onto the device, while the base of the housing can be adhesively bonded to the contact surface with thermoconductive paste or the like. The result, however, is two mechanical retention points which are geometrically spaced apart from one another, thus guaranteeing secure retention of the new apparatus on the device to be protected.

Also to be borne in mind is the fact that the adhesive bonding point between base and contact surface is strain-relieved, which entails much greater reliability than if the housing were adhesively bonded directly onto the contact surface and the connecting contact on the metal cover were used directly as an external terminal.

In a development, it is preferred if the holder comprises a retaining bracket, to be attached to the device, which carries a plastic part on which the housing and the external terminal are arranged.

This feature is advantageous in terms of design: the retaining bracket, made of plastic or metal, can be attached to the device by bolting or welding, thereby simultaneously pressing the base of the housing onto the contact surface.

A further advantage lies in the fact that the housing is thermally insulated by the plastic part, so that only the small mass of the housing itself, and optionally of the external terminal joined to it, must track the temperature of the device to be protected. Only a very small quantity of heat is required for this purpose, however, which because of the good thermal coupling can also be transferred very rapidly, so that overall, the new apparatus can react very quickly to increases in the temperature of the device to be protected.

It is further preferred if the retaining bracket comprises a carrier plate, carrying the plastic part, on which one, preferably two narrow extension arms are provided, by means of which the holder is attached to the device.

The advantage here is that the retaining bracket supplies, so to speak, double mechanical retention, so that now, together with the previously mentioned adhesive bonding point, a total of three retention points are present to attach the new apparatus to the device to be protected. The inventors have found that because of this triple security, even mechanical vibrations or thermal expansion, as for example with hotplates to be protected, do not cause the new apparatus to detach thermally or electrically from the device.

It is preferred in general terms if the plastic part has a cavity in which the housing fits with its base facing outward, and the external terminal is a connector lug which extends through the plastic part to the housing.

This feature is also advantageous in terms of design: the housing must merely be retained in press-fit fashion in the cavity, so that, for example after preassembly of the holder, it needs simply to be pressed into the cavity. Since the housing moreover is now completely—except for the base—surrounded by the plastic part, the result is good thermal insulation, so that the heat conveyed via the base from the device to be protected is completely utilized to heat up the temperature-dependent switch. This means, however, that the new apparatus tracks changes in the temperature of the housing very rapidly, and switches immediately when the defined temperature is exceeded.

It is preferred on the one hand, in this context, if the connector lug is attached to the housing and extends outward through a slot provided in the plastic part.

This feature is also advantageous in terms of design, since once the retaining bracket has been equipped with the plastic part, the connector lug simply needs to be soldered or welded onto the housing, whereupon the housing is then inserted into the cavity so that the connector lug passes through the slot, the base of the housing projecting downward slightly out of the cavity.

It is preferred on the other hand if the connector lug is attached to the plastic part and rests—preferably resiliently—against the housing inserted into the cavity.

This feature is also advantageous in terms of design: assembly of the new apparatus is extremely simple and, most of all, can be automated, which is not as easily achieved with the design using the slot because of the threading-in of the connector lug. Once the holder, with plastic part and connector lug, has been manufactured, the housing simply needs to be inserted from below into the cavity, which simultaneously creates the electrical contact between the connector lug and the housing.

It is preferred in general if the retaining bracket is manufactured from metal, and preferably has a grounding terminal.

This feature is advantageous in terms of easy installation on the device to be protected, since the metal retaining bracket can now be welded on, while a retaining bracket made of plastic would have to be bolted or adhesively bonded on, which requires considerably more time. A retaining bracket made of metal moreover ensures better mechanical retention than a retaining bracket made of plastic.

The retaining bracket then, as a rule, has a grounding terminal in order to conform to appropriate safety regulations.

It is further preferred, in general terms, if the plastic part is injection molded onto the retaining bracket.

This feature is advantageous in terms of design, since once the retaining bracket has been manufactured, the plastic part is simultaneously attached to the retaining bracket while it is being injection molded, so that two steps can be combined into one. A molded-on plastic part moreover offers very secure retention on the retaining bracket, which contributes to the overall operating reliability of the new apparatus.

It is further preferred in this context if, as the plastic part is being injection molded on, the plastic part is also insert molded around the connector lug.

The advantage here is that with a single operation, namely attachment of the plastic part by injection molding, two further production steps are completed at the same time, namely attaching the plastic part to the retaining bracket and attaching the connector lug to the plastic part.

In this connection, the following steps are preferred in a method for producing an apparatus for protecting an electrical device from overtemperature:

a) producing a retaining bracket from metal, with a connector lug joined integrally thereto by means of retaining flanges;

b) partially injection-embedding the retaining bracket in plastic, to produce a plastic part, attached to the retaining bracket, having a cavity to receive a temperature-dependent switch, such that the connector lug projects with its one end into the cavity;

c) removing the retaining flanges in order to disconnect the connector lug electrically from the retaining bracket; and d) inserting the switch into the cavity so that it comes into contact, with its housing, with the one end of the connector lug, and the housing projects at its base out of the cavity.

In addition to the advantages already mentioned in terms of good thermal contact and mechanically secure retention on the device to be protected, a further advantage here is that the new apparatus is extremely easy to manufacture: in a first step, the retaining bracket with integrated connector lug is punched out of a sheet-metal part and appropriately prebent, whereupon then, in the next step, the plastic part is injection molded on so that the connector lug extends with its lower end into the cavity. All that is now necessary in order to complete the new apparatus is for the connections between the connector lug and retaining bracket to be severed, and the switch or its housing to be inserted into the cavity. All of the manufacturing steps so far described can easily be automated, so that the new apparatus can be produced very economically.

Further advantages are evident from the description and the appended drawings.

It is understood that the features mentioned above and those yet to be explained below can be used not only in the respective combinations indicated, but also in other combinations or in isolation, without leaving the scope of the present invention.

BRIEF DESCRIPTION OF THE DRAWINGS

Embodiments of the invention are depicted in the drawings and will be explained in more detail in the description below. In the drawings.

DETAILED DESCRIPTION OF PREFERRED EMBODIMENTS

Figure 1:
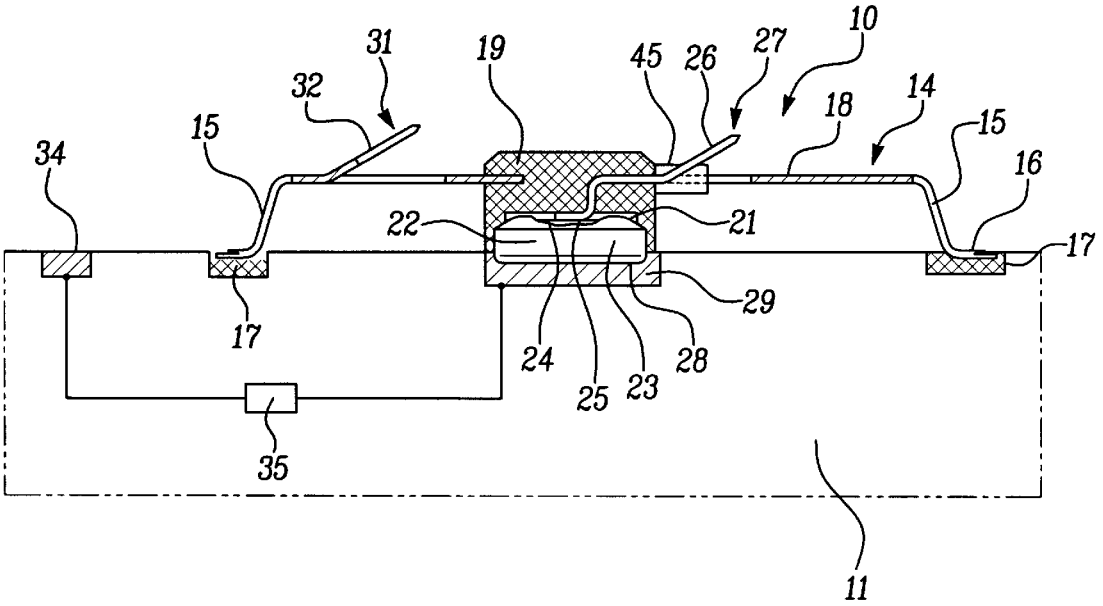
FIG. 1 shows a new apparatus in a sectioned side view, the connection to a device to be protected being shown schematically.

In FIG. 1, 10 designates a new apparatus whose arrangement on an electrical device 11 to be protected is indicated schematically, apparatus 10 itself being visible, in a first embodiment, in a sectioned side depiction.

Apparatus 10 comprises a retaining bracket 14 which has at each of its two ends a narrow extension arm 15 whose feet 16 are attached to insulated retaining points 17 of device 11, for example by welding.

Extending between the narrow extension arms 15 is a wider carrier plate 18 which carries a molded-on plastic part 19.

Provided beneath carrier plate 18 in plastic part 19 is a cavity 21, open downwards in FIG. 1, in which a temperature-dependent switch 22 is arranged. Switch 22 has a housing 23, preferably made of metal, and rests with its cover 24, which is a first connecting contact of switch 22, in contact with an inner end 25 of a connector lug 26 which extends in zigzag fashion through plastic part 19 and is securely held thereby. Thus, connector lug 26 constitutes an external terminal 27 of both apparatus 10 and device 11.

Housing 23 rests, with its base or underside 28 which simultaneously acts as second connecting contact of switch 22, on a contact surface 29 of device 11. Said contact surface 29 provides both an electrical connection between switch 22 and device 11, and good thermal coupling between housing 23 and electrical device 11.

Retaining bracket 14 itself is made of metal; a grounding terminal 31 in the form of a bent-up tab 32 is therefore provided in order to ground retaining bracket 14 and thus satisfy safety requirements, in particular in the case of household electrical appliances.

A further external terminal of electrical device 11 is also shown schematically at 34. In the embodiment according to FIG. 1, let it be assumed that the electrical device is a hotplate with a thick-film heating system, which is to be indicated by a heating resistor 35.

In a hotplate of this kind, on the one hand insulated retaining points 17 for feet 16, and the other hand a contact surface 29, are provided. When apparatus 10 is then, as shown in FIG. 1, attached to device 11, on the one hand feet 16 are welded onto retaining points 17, while on the other hand base 28 is adhesively bonded to contact surface 29. Feet 16 are located, with reference to base 28, at a height such that they press base 28 firmly against contact surface 29, which is possible because retaining bracket 14 is resilient since it is made of metal.

The mechanical mounting of apparatus 10 on device 11 results simultaneously in both a thermal coupling and an electrical series connection between switch 22 and heating resistor 35, which are now connected in series between the two external terminals 27 and 34. A further new apparatus 10 can be connected to external terminal 34, which can also act as a contact surface similar to surface 29, so that only two new apparatuses need to be soldered or welded, in the manner described, onto a hotplate with a thick-film resistor, whereupon the two external terminals 27 can then simultaneously serve as external terminals of device 11.

The manner in which apparatus 10 of FIG. 1 is produced will now be explained in conjunction with the plan view of apparatus 10 shown in FIG. 2.

It is first of all evident that tab 32 rests in a punched-out area 37 of carrier plate 18, i.e. is manufactured integrally with the carrier plate.

A further punched-out area 38, whose cut boundary is indicated with dashed lines at 39, is evident in the region of connector lug 26 and of plastic part 19. In the production of retaining bracket 14, first the outer contours and punched-out areas 37, 38 are cut out, whereupon extension arms 15 with feet 16 are then correspondingly bent over, as is shown in FIG. 1.

Connector lug 26 manufactured integrally with carrier plate 18 lies in the plane of carrier plate 18 and is retained on carrier plate 18 by retaining flanges 41, 42 and extensions 43, 44. Next, connector lug 26 is bent as shown in the side view in FIG. 1. Plastic part 19 is then molded on, so that connector lug 26 becomes an integral component of plastic part 19 and its inner free end 25 ends up located in cavity 21.

Next, retaining flanges 41, 42 are then cut loose in order to disconnect connector lug 26 electrically from carrier plate 18.

In the last manufacturing step, all that is now necessary is to slide switch 22 from below into cavity 21, so that it comes into contact at its cover 24 with the inner end 25 of connector lug 26, thus making contact to it. Housing 23 is retained in cavity 21 by a press-fit effect.

Figure 2:
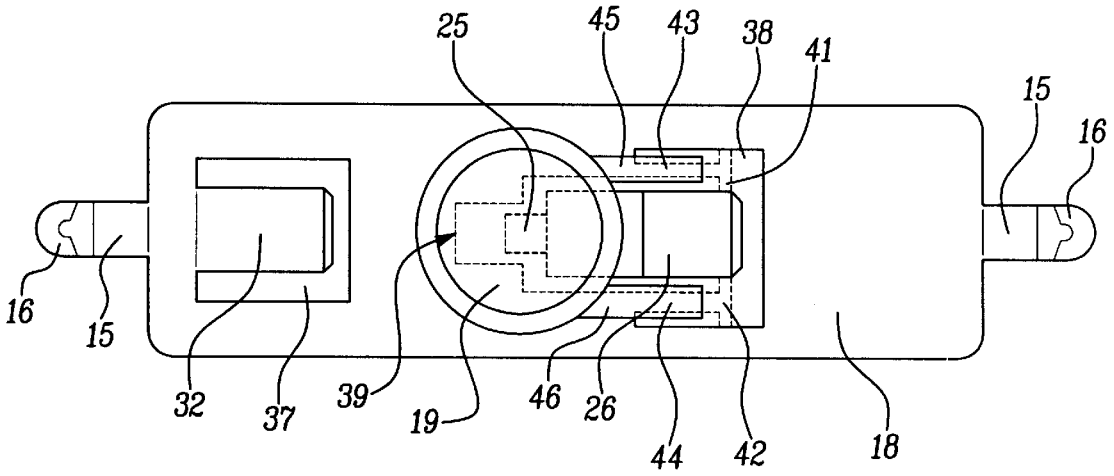
FIG. 2 shows a plan view of the new apparatus of FIG. 1.

It is also evident from FIG. 2 that extensions 43 and 44 are surrounded by plastic extension arms 45, 46 which are manufactured concurrently when plastic part 19 is molded on. Once connector lug 26 has been bent out of the plane of carrier plate 18, as is evident from FIG. 1, the two plastic extension arms 45, 46 additionally provide for insulation of a cable shoe, slid onto connector lug 26, with respect to carrier plate 18.

Figure 3:
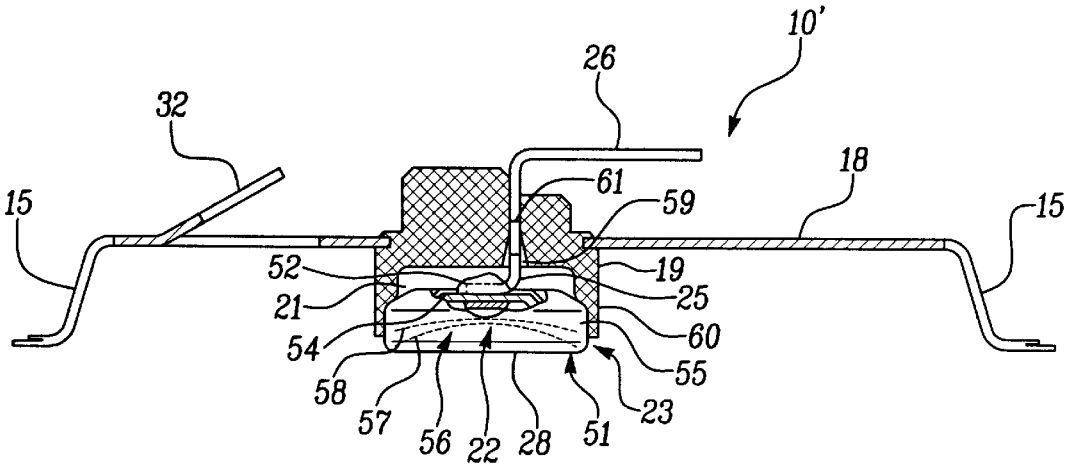
FIG. 3 shows a second embodiment of the new apparatus, in a depiction like that of FIG. 1.

FIG. 3 shows a further embodiment of a new apparatus 10', in a depiction like that of FIG. 1. In the depiction in FIG. 3, it is first of all more clearly apparent that switch 22 has a two-part housing 23 made of metal, a first connecting contact 51 being configured on base 28, while a second connecting contact 52 is configured on a metal cover 54 which is electrically insulated, in a manner known per se, with respect to a metal lower part 55. The electrical connection between metal cover 54 and metal lower part 55 is provided, in known fashion, by a schematically indicated bimetallic switching mechanism 56 having a spring disk 57 and bimetallic disk 58. Such a switch is e.g. described in DE-A-21 21 802, the content of which is hereby fully incorporated by reference.

Below the defined switching temperature of bimetallic switching mechanism 56, spring disk 57 provides an electrical connection between metal cover 54 and metal lower part 55, so that an electrical connection exists between connector lug 26 and base 28. If the temperature of the device to be protected rises, the thermal coupling to base 28 also causes the temperature of switch 22 to rise. Once the temperature reaches a defined value, bimetallic disk 58 kicks over into its other configuration and thereby pushes spring disk 57 away from metal cover 54, so that the electrical connection between connector lug 26 and base 28 is interrupted.

In the case of apparatus 10' in FIG. 3, connector lug 26 is not injection-embedded along with plastic part 19, but rather sits in a slot 59 which extends outward from cavity 21.

Assembly of apparatus 10' is accomplished in such a way that retaining bracket 14 with carrier plate 18 and extension arms 15 is first punched and preshaped, whereupon plastic part 19 is then molded on.

Connector lug 26 is then welded onto connecting contact 52 of housing 23. Next, switch 22 is slid from below into cavity 21, being in the process aligned so that connector lug 26 slides through slot 59. The insertion of switch 22 into cavity 21 is limited by a circumferential shoulder 60 which is provided internally inside cavity 21. When housing 23 is in contact with shoulder 60, a snap-lock 61 snaps into place between slot 59 and connecting connector lug 26, so that connector lug 26 and housing 23 are retained in lossproof fashion on plastic part 19.

Apparatus 10' is then installed on a device to be protected in the same manner as already described with reference to FIG. 1.

Figure 4:
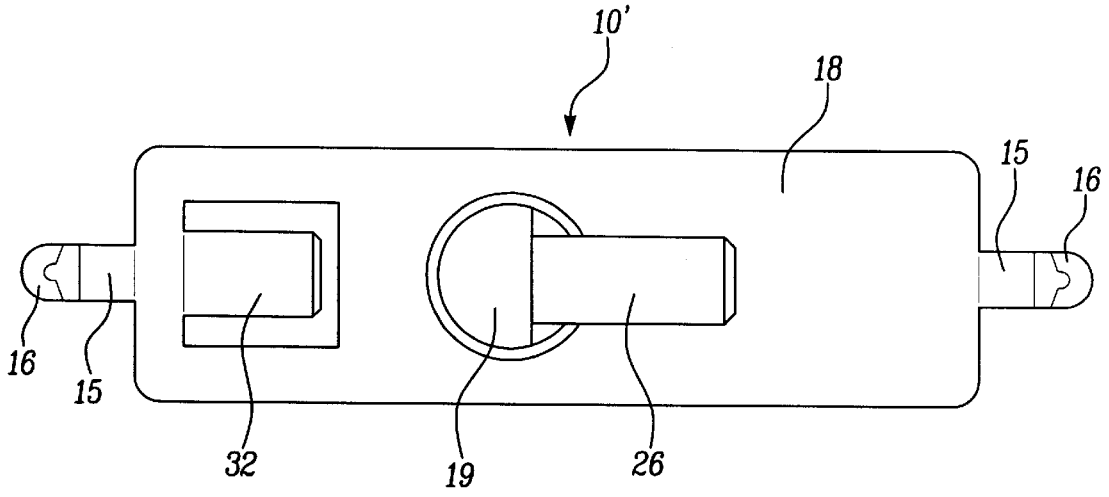
FIG. 4 shows a plan view of the apparatus of FIG. 3.

FIG. 4 shows a further plan view of the new apparatus 10' of FIG. 3.

Therefore, what I claim is:

1. An apparatus for protecting an electrical device against overtemperature, comprising:

a temperature-dependent switch having a housing with a base, a first connecting contact of said switch being provided at said base, and a second connecting contact of said switch being provided on said housing and isolated against said first connecting contact; and a holder carrying said housing and being electrically insulated with respect to said base, said holder having an external terminal connected to said second connecting contact, said holder being constructed such that when mounted on said device said holder presses said housing onto said device such that said base comes into electrical and thermal contact with a contact surface present on said device.

2. An apparatus as in claim 1, wherein the holder comprises a retaining bracket to be attached to the device, said bracket carrying a plastic part on which the housing and the external terminal are arranged.

3. An apparatus as in claim 2, wherein the retaining bracket comprises a carrier plate carrying the plastic part, on said carrier plate one, preferably two narrow extension arms are provided, by means of which the holder is attached to the device.

4. An apparatus as in claim 3, wherein the plastic part has a cavity in which the housing fits with its base facing outward, and the external terminal is a connector lug which extends through the plastic part to the housing.

5. An apparatus as in claim 4, wherein the connector lug is attached to the housing and extends outward through a slot provided in the plastic part.

6. An apparatus as in claim 4, wherein the connector lug is attached to the plastic part and rests resiliently against the housing inserted into the cavity.

7. An apparatus as in claim 2, wherein the retaining bracket is manufactured from metal, and has a grounding terminal.

8. An apparatus as in claim 2, wherein the plastic part is injection molded onto the retaining bracket.

9. An apparatus as in claim 8, wherein as the plastic part is being injection molded on, the plastic part is also insert molded around the connector lug.

10. A method for producing an apparatus for protecting an electrical device from overtemperature, comprising the steps of:

a) producing a retaining bracket from metal, with a connector lug joined integrally thereto by means of retaining flanges;

b) partially injection-embedding the retaining bracket in plastic, to produce a plastic part, attached to the retaining bracket, having a cavity to receive a temperature-dependent switch, such that the connector lug projects with its inner end into the cavity;

c) removing the retaining flanges in order to disconnect the connector lug electrically from the retaining bracket; and d) inserting the switch into the cavity so that it comes into contact, with its housing, with the inner end of the connector lug, and the housing projects at its base out of the cavity.

* * * * *